US010283047B2

(12) United States Patent
Shin et al.

(10) Patent No.: US 10,283,047 B2
(45) Date of Patent: May 7, 2019

(54) DISPLAY DEVICE AND METHOD OF DRIVING THE SAME

(71) Applicant: Samsung Display Co., Ltd., Yongin-si (KR)

(72) Inventors: Jeong Hwan Shin, Yongin-si (KR); Sung Hoon Bang, Yongin-si (KR); Sung Hwan Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 84 days.

(21) Appl. No.: 15/662,187

(22) Filed: Jul. 27, 2017

(65) Prior Publication Data

US 2018/0061316 A1 Mar. 1, 2018

(30) Foreign Application Priority Data

Aug. 31, 2016 (KR) ..... 10-2016-0112122

(51) Int. Cl.

| | |
|---|---|
| ***G09G 5/10*** | (2006.01) |
| ***G09G 3/3233*** | (2016.01) |
| ***G09G 3/3266*** | (2016.01) |
| ***G09G 3/3275*** | (2016.01) |

(52) U.S. Cl.

CPC ..... *G09G 3/3233* (2013.01); *G09G 3/3266* (2013.01); *G09G 3/3275* (2013.01); *G09G 2310/027* (2013.01); *G09G 2310/08* (2013.01); *G09G 2330/02* (2013.01)

(58) Field of Classification Search

CPC .. G09G 3/3233; G09G 3/3275; G09G 3/3266; G09G 2330/02; G09G 2310/08; G09G 2310/027; G09G 2310/0278; G09G 2310/0286; G09G 2320/045

See application file for complete search history.

(56) References Cited

U.S. PATENT DOCUMENTS

2015/0029171 A1* 1/2015 Jo ..... G09G 3/3258 345/212
2015/0187273 A1* 7/2015 Chang ..... G09G 3/3233 345/690
2016/0086539 A1 3/2016 Mizukoshi

FOREIGN PATENT DOCUMENTS

KR 10-2015-0079090 7/2015

* cited by examiner

*Primary Examiner* — Adam R. Giesy
(74) *Attorney, Agent, or Firm* — H.C. Park & Associates, PLC

(57) ABSTRACT

A display device is configured to be driven in a period that is divided into a driving period and a sensing period. The display device includes pixels including driving transistors coupled to scan lines, data lines, and sensing lines, a scan driver configured to supply scan signals to the scan lines, a data driver configured to supply at least one of a reference voltage and data signals to the data lines, a sensing unit configured to sense the characteristic information via the sensing lines during the sensing period, control lines formed in parallel with the scan lines, a first switch coupled between an n-th scan line and an n-th control line, and a second switch coupled between the n-th control line and an (n+1)-th scan line and configured such that a turn-on period of the second switch does not overlap a turn-on period of the first switch.

20 Claims, 9 Drawing Sheets

DISPLAY DEVICE AND METHOD OF DRIVING THE SAME

CROSS-REFERENCE TO RELATED APPLICATION

This application claims priority from and the benefit of Korean Patent Application No. 10-2016-0112122, filed on Aug. 31, 2016, which is hereby incorporated by reference for all purposes as if fully set forth herein.

BACKGROUND

Field

Exemplary embodiments relate to a display device and a method of driving the display device. More particularly, exemplary embodiments relate to a display device and a method of driving the display device, which can improve image quality.

Discussion of the Background

With the development of information technology, the importance of a display device that is a connection medium between a user and information has been emphasized. To satisfy the demand for display devices, the use of various display devices, such as a liquid crystal display (LCD) device and an organic light-emitting display device, has increased.

Among the display devices, an organic light-emitting display device displays an image using pixels coupled to a plurality of scan lines and data lines. For this operation, each of the pixels has an organic light-emitting diode and a driving transistor.

The driving transistor controls the amount of current that is supplied to the organic light-emitting diode in response to a data signal supplied from the corresponding data line. Here, the organic light-emitting diode generates light having predetermined luminance in response to the amount of current supplied from the driving transistor.

In order for the display device to display an image having uniform image quality, driving transistors included in respective pixels should supply a uniform current to organic light-emitting diodes in response to data signals. However, driving transistors included in respective pixels have their inherent characteristic values in which deviations may be present.

For example, the threshold voltages and mobility values of the driving transistors may be set differently for respective pixels, and thus the image quality may be deteriorated.

The above information disclosed in this Background section is only for enhancement of understanding of the background of the inventive concepts, and, therefore, it may contain information that does not form the prior art that is already known in this country to a person of ordinary skill in the art.

SUMMARY

Exemplary embodiments provide a display device and a method of driving the display device, which may compensate for deviations between the characteristics of driving transistors of corresponding pixels, thus improving image quality.

Additional aspects will be set forth in the detailed description which follows, and, in part, will be apparent from the disclosure, or may be learned by practice of the inventive concepts.

According to exemplary embodiments, a display device includes pixels including driving transistors disposed to be coupled to scan lines, data lines, and sensing lines, a scan driver configured to supply scan signals to the scan lines, a data driver configured to supply at least one of a reference voltage and data signals to the data lines, a sensing unit configured to sense the characteristic information of the driving transistors via the sensing lines during the sensing period, control lines formed in parallel with the scan lines, a first switch coupled between an n-th scan line (where n is a natural number) and an n-th control line, and a second switch coupled between the n-th control line and an (n+1)-th scan line and configured such that a turn-on period of the second switch does not overlap a turn-on period of the first switch. The display device is configured to be driven such in a period that is divided into a driving period during which an image is displayed and a sensing period during which characteristic information of driving transistors included in respective pixels is sensed.

In an exemplary embodiment, the reference voltage may be set to a voltage that allows current to flow through of the driving transistors.

In an exemplary embodiment, the first switch may be turned on during the driving period.

In an exemplary embodiment, the scan driver may sequentially supply scan signals to the scan lines during the driving period.

In an exemplary embodiment, a scan signal supplied to the (n+1)-th scan line may overlap a scan signal supplied to the n-th scan line in a partial period of an entire period of each scan signal.

In an exemplary embodiment, the sensing period may be set to a first sensing period during which mobility information of a driving transistor is sensed and a second sensing period during which threshold voltage information of driving transistor is sensed.

In an exemplary embodiment, the second switch may be turned on during the first sensing period.

In an exemplary embodiment, the scan driver may sequentially supply scan signals to the scan lines during the driving period.

In an exemplary embodiment, a scan signal supplied to the n-th scan line and a scan signal supplied to the n-th control line may overlap each other in a partial period of an entire period of each scan signal.

In an exemplary embodiment, the data driver may be configured to sequentially supply a data signal having a black grayscale level and the reference voltage to the data lines during the partial period.

In an exemplary embodiment, the first switch may be turned on during the second sensing period.

In an exemplary embodiment, the scan driver may sequentially supply scan signals to the scan lines during the second sensing period, wherein the scan signals do not overlap each other.

In an exemplary embodiment, the data driver may be configured to supply the reference voltage to the data lines during a partial period of an entire period in which the scan signals are supplied.

In an exemplary embodiment, the sensing unit may include third switches respectively formed between an initialization power source and the sensing lines, an analog-to-digital converter coupled to at least one of the sensing lines and configured to convert voltages applied to the sensing lines into digital sensing data depending on the characteristic information of the driving transistors, and a compensator including a memory for storing the sensing data.

In an exemplary embodiment, the third switches may be configured such that the third switches are set to a turned-on state during the driving period and are repeatedly turned on and off during the sensing period.

In an exemplary embodiment, the sensing unit may further include fourth switches disposed between the respective sensing lines and the analog-to-digital converter and configured such that turn-on periods of the fourth switches do not overlap turn-on periods of the third switches.

In an exemplary embodiment, each of pixels located on an n-th horizontal line may include an organic light-emitting diode, a driving transistor configured to control an amount of current that flows from a first driving power source to a second driving power source via the organic light-emitting diode in response to a voltage of a first node, a second transistor coupled between the first node and a data line, and a gate electrode of the second transistor is coupled to the n-th scan line, a third transistor coupled between a second electrode of the driving transistor and a sensing line, and a gate electrode of the third transistor is coupled to the n-th control line, and a storage capacitor coupled between the first node and the second electrode of the driving transistor.

In an exemplary embodiment, the display device may further include a timing controller configured to generate second data using first data that is externally supplied depending on the characteristic information.

Further, the present disclosure provides a method that includes, during the first sensing period, turning on a second transistor coupled between a gate electrode of each driving transistor and a data line, turning on a third transistor coupled between a second electrode of the driving transistor and a sensing line after the second transistor has been turned on, sequentially supplying the data line with a data signal that has a black grayscale level and a reference voltage that allows current to flow through the driving transistor, turning off the second transistor, and sensing a voltage applied to the sensing line as the mobility information while maintaining the third transistor in a turned-on state. The display device is configured to be driven in a period that is divided into a driving period during which an image is displayed, a first sensing period during which mobility information of driving transistors included in respective pixels is sensed, and a second sensing period during which threshold voltage information of the driving transistors is sensed.

In an exemplary embodiment, the method may further include, during the second sensing period, simultaneously turning on the second transistor and the third transistor, initializing the sensing line to a voltage of an initialization power source, supplying the reference voltage to the data line, and sensing a voltage applied to the sensing line as the threshold voltage information.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIG. 7 is a diagram illustrating mobility sensing voltages depending on whether a second transistor and a third transistor illustrated in FIG. 2A are turned on.

DETAILED DESCRIPTION OF THE ILLUSTRATED EMBODIMENTS

Figure 1:
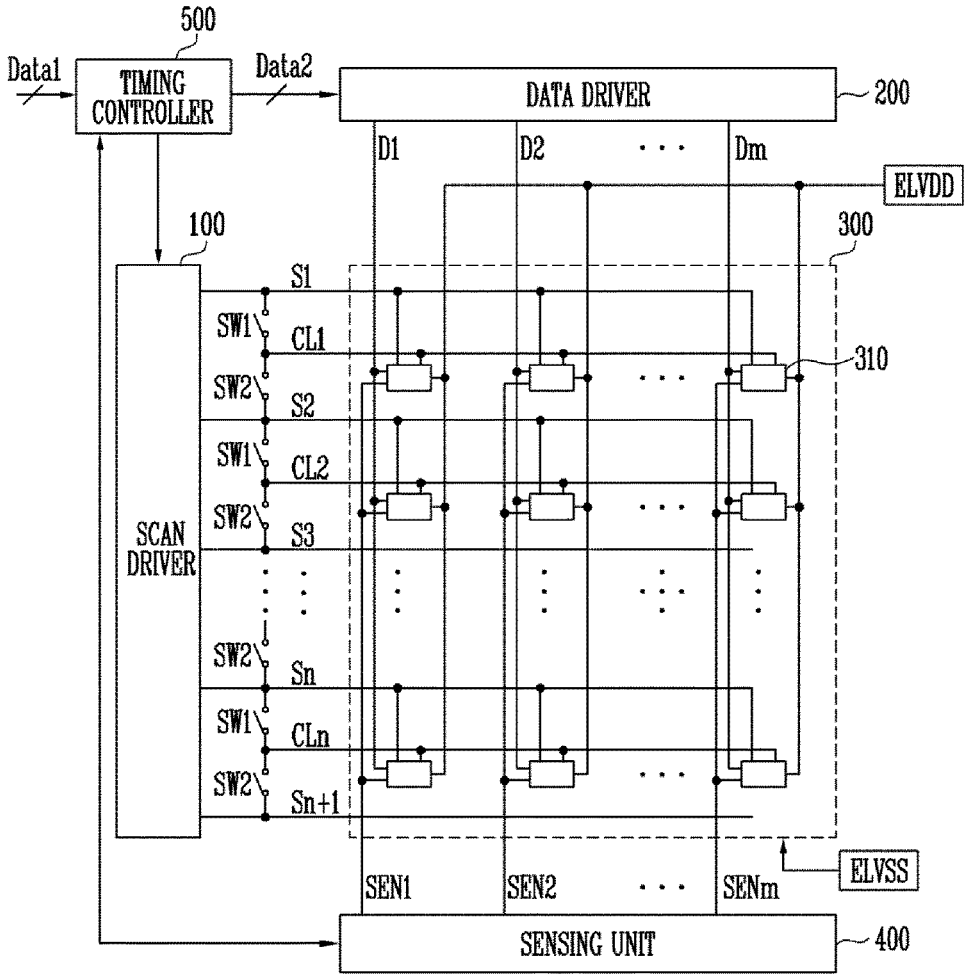
FIG. 1 is a diagram illustrating a display device according to an exemplary embodiment of the present disclosure.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

FIG. 1 is a diagram illustrating a display device according to an exemplary embodiment. Although FIG. 1 will be described under the assumption that the display device is an organic light-emitting display device, this is merely for the convenience. Instead, the display device of the present disclosure is not limited to an organic light-emitting display device and may be a liquid crystal display device or a micro-LED display device.

Referring to FIG. 1, the display device may include a scan driver 100, a data driver 200, a pixel unit 300, a sensing unit 400, and a timing controller 500.

The display device according to an exemplary embodiment of the present disclosure may be driven by a period divided into a sensing period and a driving period. The sensing period is set to a period during which information about deviations between driving transistors included in respective pixels 310 is extracted. For this operation, the sensing period may be driven so that it is divided into a first sensing period during which the mobility information of driving transistors included in the respective pixels 310 is extracted, and a second sensing period during which the threshold voltage information of the driving transistors included in the respective pixels 310 is extracted. The driving period is set to a period during which an image is displayed in response to data signals.

The scan driver 100 supplies scan signals to scan lines S1 to Sn+1 under the control of the timing controller 500. For example, the scan driver 100 may sequentially supply scan signals to the scan lines S1 to Sn+1. When the scan signals are sequentially supplied to the scan lines S1 to Sn+1, the pixels 310 are selected on a horizontal line basis. For this operation, the scan signals are set to gate-on voltages that enable the transistors included in the pixels 310 to be turned on.

Additionally, the scan driver 100 may supply a scan signal to an (n+1)-th scan line Sn+1 (where n is a natural number) so that the scan signal supplied to the (n+1)-th scan line Sn+1 overlaps a scan signal supplied to an n-th scan line Sn in a partial period of the entire period of each scan signal. Additionally, the scan driver 100 may supply a scan signal to the scan line Sn+1 so that the scan signal supplied to the scan line Sn+1 does not overlap a scan signal supplied to the scan line Sn.

For example, during the driving period and the first sensing period, the scan driver 100 may supply a scan signal to the scan line Sn+1 so that the scan signal supplied to the scan line Sn+1 overlaps a scan signal supplied to the scan line Sn in a partial period of the entire period of each scan signal. Additionally, during the second sensing period, the scan driver 100 may supply a scan signal to the scan line Sn+1 so that the scan signal supplied to the scan line Sn+1 does not overlap the scan signal supplied to the scan line Sn.

The data driver 200 supplies a reference voltage and/or data signals to the data lines D1 to Dm under the control of the timing controller 500.

The data driver 200 is supplied with second data Data2 from the timing controller 500 during the driving period, and generates data signals in response to the supplied second data Data2. The data driver 200 that generates the data signals supplies the data signals to the data lines D1 to Dm. The data signals supplied to the data lines D1 to Dm are provided to pixels 310 selected by the scan signals. Then, the pixels 310 emits light having luminance corresponding to the data signals during the driving period, and thus an image is displayed on the pixel unit 300.

The data driver 200 repeatedly supplies data signals having a first grayscale level and a reference voltage to the data lines D1 to Dm during the first sensing period. For example, the data driver 200 may sequentially supply a data signal having a first grayscale level, a reference voltage, a data signal having a first grayscale level, and the reference voltage to the data lines D1 to Dm during a period in which scan signals are supplied. Here, the first grayscale level may be set to a data signal having a black grayscale level. Further, the reference voltage may be set to a predetermined voltage that enables current to flow through the driving transistor included in each of the pixels 310.

The data driver 200 supplies the reference voltage to the data lines D1 to Dm during the second sensing period. For example, the data driver 200 may supply the reference voltage to the data lines D1 to Dm during at least a partial period of the period during which scan signals are supplied.

On the other hand, the above-described second data Data2 may be a value based on the first data Data1 that is externally input in accordance with an image desired to be displayed on the pixel unit 300. The second data Data2 may be set to a value obtained by changing the first data Data1 so that deviations between the driving transistors included in the respective pixels 310 may be taken into account and compensated for.

The sensing unit 400 is coupled to sensing lines SEN1 to SENm disposed in parallel to the data lines D1 to Dm, respectively. Such a sensing unit 400 senses the characteristic information of the driving transistors included in the respective pixels 310 during a sensing period under the control of the timing controller 500. For example, the sensing unit 400 may sense the mobility information of the driving transistors included in the respective pixels 310 during the first sensing period. The sensing unit 400 may also sense the threshold voltage information of the driving transistors included in the respective pixels 310 during the second sensing period.

Control lines CL1 to CLn are arranged in parallel to the scan lines S1 to Sn+1. The control lines CL1 to CLn may be electrically coupled to any one of the scan lines S1 to Sn+1. For this operation, the display device includes a plurality of first switches SW1 and a plurality of second switches SW2.

Each of the first switches SW1 is disposed between a scan line and a control line that are located on the same horizontal line. For example, a first switch SW1 is disposed between a scan line Sn and a control line CLn. In this case, when the first switch SW1 is turned on, the scan line Sn is electrically coupled to the control line CLn. Therefore, when the first switch SW1 is turned on, the control line CLn is supplied with a scan signal from the scan line Sn.

Each second switch SW2 is disposed between a control line located on a current horizontal line and a scan line located on a subsequent horizontal line. For example, the second switch SW2 is disposed between the control line CLn and a scan line Sn+1. In this case, when the second switch SW2 is turned on, the control line CLn is electrically coupled to the scan line Sn+1. Therefore, when the second switch SW2 is turned on, the control line CLn is supplied with a scan signal from the scan line Sn+1. The turn-on periods of the first switch SW1 and the second switch SW2 do not overlap each other. Details related to the operating procedures of the first switch SW1 and the second switch SW2 will be described later with reference to driving waveforms.

The pixel unit 300 includes pixels 310 which are disposed to be coupled to the plurality of scan lines S1 to Sn, control lines CL1 to CLn, sensing lines SEN1 to SENm, and data lines D1 to Dm. Here, the pixel unit 300 may be set to a display region in which an image is displayed. Each of the pixels 310 is electrically coupled to a first driving power source ELVDD and a second driving power source ELVSS. Here, the voltage of the first driving power source ELVDD may be set to a voltage higher than that of the second driving power source ELVSS.

Each of the pixels 310 includes a driving transistor and an organic light-emitting diode. The driving transistor controls the amount of current that flows from the first driving power source ELVDD to the second driving power source ELVSS via the organic light-emitting diode in response to a data signal. In this case, the organic light-emitting diode emits light at luminance corresponding to the amount of current that is supplied from the driving transistor. However, when a data signal corresponding to a black grayscale level is supplied, the driving transistor performs control such that current does not flow to the organic light-emitting diode, and thus the organic light-emitting diode is set to a non-luminous state.

The timing controller 500 controls the scan driver 100, the data driver 200, and the sensing unit 400. Further, the timing controller 500 may generate second data Data2 by changing a bit of the first data Data1 depending on the information about the deviations between the driving transistors, which is sensed by the sensing unit 400.

Meanwhile, only components required to describe the present disclosure are illustrated in FIG. 1, and various components may be added to an actual display device. For example, for the stability of driving, one or more dummy scan lines may be additionally included in the display device. Further, the scan driver 100, the data driver 200, the sensing unit 400 and/or the timing controller 500 may be mounted, together with the pixel unit 300, in a panel (not illustrated). Similarly, the first switches SW1 and the second switches SW2 may also be mounted in the panel or may be located outside the panel.

Figure 2A:
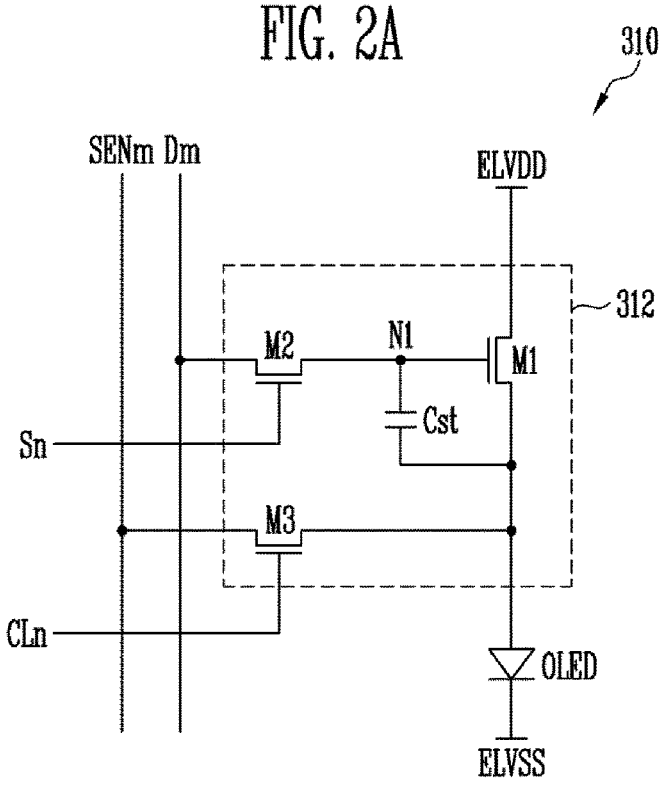
FIGS. 2A and 2B are diagrams illustrating exemplary embodiments of a pixel illustrated in FIG. 1.

FIG. 2A is a diagram illustrating an exemplary embodiment of a pixel illustrated in FIG. 1. In FIG. 2A, for convenience, a pixel is illustrated as being coupled to an m-th data line Dm and an n-th scan line Sn.

Referring to FIG. 2A, a pixel 310 according to an exemplary embodiment of the present disclosure includes an organic light-emitting diode (OLED) and a pixel circuit 312.

An anode electrode of the OLED is coupled to the pixel circuit 312, and a cathode electrode of the OLED is coupled to a second driving power source ELVSS. Such an OLED emits light at luminance corresponding to the amount of current supplied from the pixel circuit 312.

The pixel circuit 312 controls the amount of current that flows from a first driving power source ELVDD to the second driving power source ELVSS via the OLED in response to a data signal. For this operation, the pixel circuit 312 includes a first transistor M1 (driving transistor), a second transistor M2, a third transistor M3, and a storage capacitor Cst.

Here, at least one of the first transistor M1 to the third transistor M3 may be set to an oxide semiconductor thin film transistor that includes an active layer made of oxide semiconductor. Further, at least one of the first transistor M1 to the third transistor M3 may be set to a low-temperature polycrystalline silicon (LTPS) thin film transistor that includes an active layer made of polysilicon. For example, in an exemplary embodiment, the first transistor may include an oxide semiconductor as an active layer and the third transistor may include a LTPS thin film transistor with polysilicon as its active layer.

A first electrode of the first transistor M1 is coupled to the first driving power source ELVDD, and a second electrode of the first transistor M1 is coupled to the anode electrode of the OLED. Further, a gate electrode of the first transistor M1 is coupled to a first node N1. Such a first transistor M1 controls the amount of current that flows from the first driving power source ELVDD to the second driving power source ELVSS via the OLED in response to the voltage of the first node N1.

A first electrode of the second transistor M2 is coupled to the data line Dm and a second electrode of the second transistor M2 is coupled to the first node N1. Also, the gate electrode of the second transistor M2 is coupled to the scan line Sn. Such a second transistor M2 is turned on when a scan signal is supplied to the scan line Sn, and then electrically couples the data line Dm to the first node N1.

A first electrode of the third transistor M3 is coupled to the second electrode of the first transistor M1, and a second electrode of the third transistor M3 is coupled to a sensing is line SENm. Also, a gate electrode of the third transistor M3 is coupled to a control line CLn. Such a third transistor M3 is turned on when the scan signal is supplied to the control line CLn by electrically coupling the sensing line SENm to the second electrode of the first transistor M1.

The storage capacitor Cst is coupled between the first node N1 and the second electrode of the first transistor M1. Such a storage capacitor Cst stores the voltage of the first node N1.

Figure 2B:
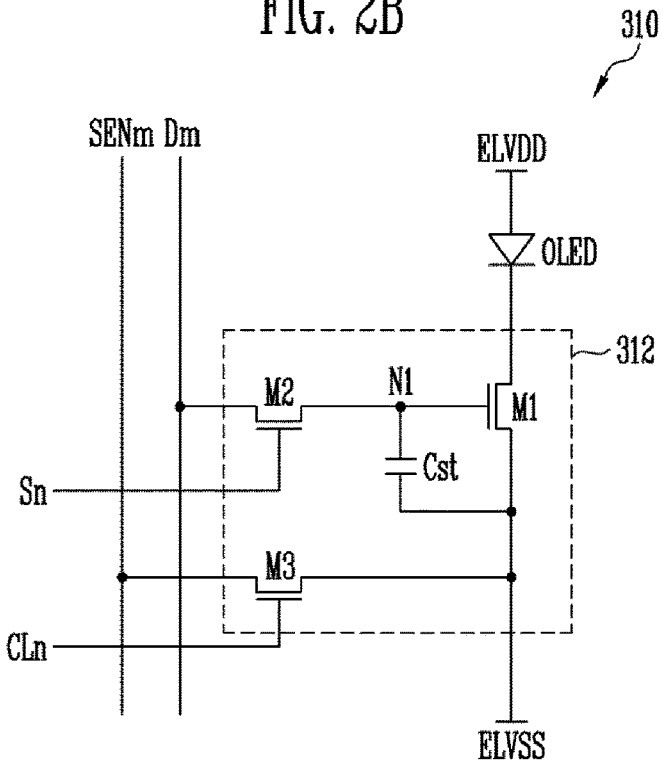

The circuit structure of the pixel 310 is not limited by FIG. 2A. For example, in an exemplary embodiment of the present disclosure, the OLED may also be disposed between the first driving power source ELVDD and the first electrode of the first transistor M1, as illustrated in FIG. 2B. That is, in an exemplary embodiment of the present disclosure, the circuit structure of the pixel 310 may be variously modified to include the third transistor M3 for sensing the characteristic information of the first transistor M1.

The luminance of the pixel 310 is chiefly determined by the data signal. However, the characteristic value of the first transistor M1 may be additionally reflected in the luminance of the pixel 310. That is, in an exemplary embodiment of the present disclosure, an external compensation scheme is applied for sensing the characteristic information of the first transistor M1 during the sensing period and changing first data Data1 in consideration of the sensed characteristic information. In this case, the pixel unit 300 may display images having uniform image quality regardless of deviations in the characteristics of the first transistor M1.

In an exemplary embodiment, the sensing period, during which the characteristic information of the first transistor M1 included in each of the pixels 310 is sensed, may be executed at least once before the display device is released. In this case, before the display device is released, the initial characteristic information of each first transistor M1 is stored, and the first data Data1 is corrected (i.e., the second data Data2 is generated) using the characteristic information. Thus, the corrected data (Data 2) enables the pixel unit 300 to display images having uniform image quality that is not as affected by differences in characteristic information (e.g., threshold voltages and mobility values) of first transistors M1 of other pixels.

Further, the sensing period may be executed at time intervals after the display device is actually used. For example, the sensing period may be arranged at time intervals in a part of a period during which the display device is turned on and/or a period during which the display device is turned off. Then, even if the characteristics of the driving transistors included in the respective pixels 310 are changed in accordance with the amount of use, the characteristic information may be updated in real time, and may then be reflected in the generation of data signals. Therefore, the pixel unit 300 may continuously display images having uniform image quality that are minimally or unaffected by changes in characteristic information of first transistors of other pixels.

Figure 3A:
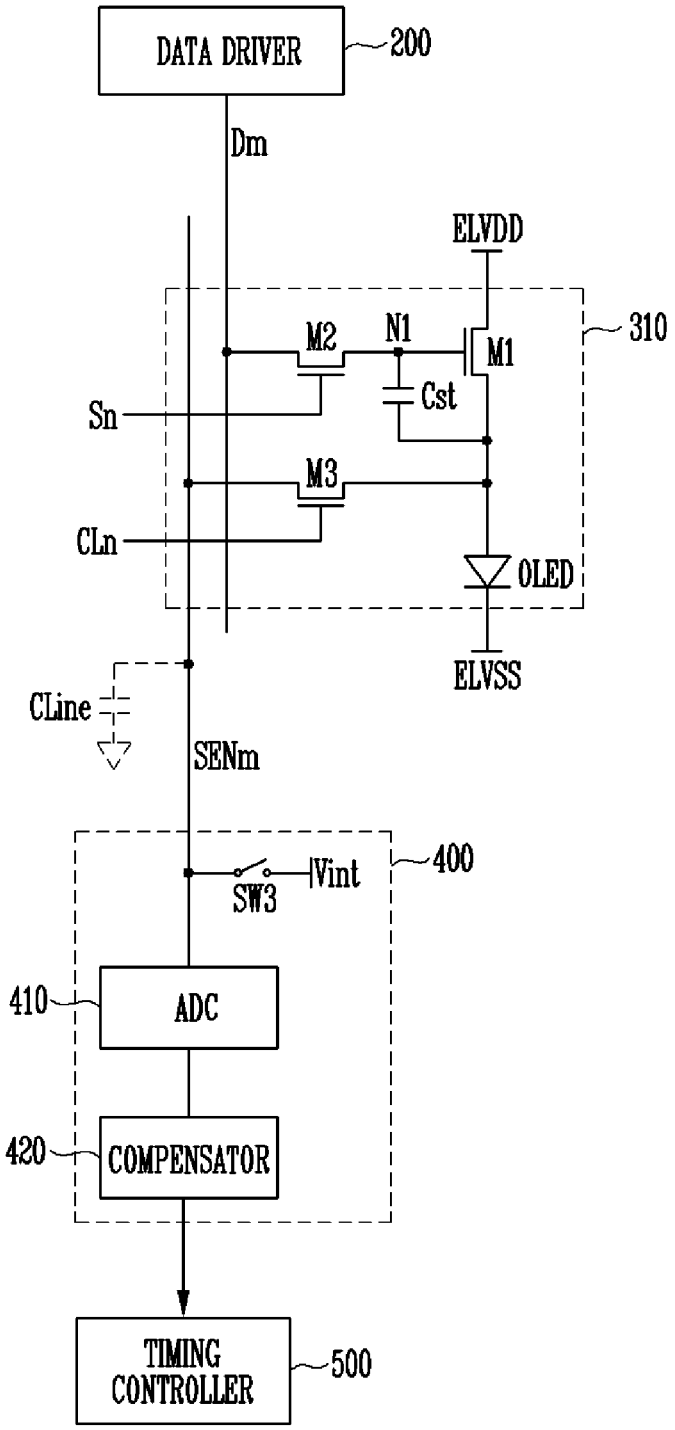
FIGS. 3A and 3B are diagrams illustrating exemplary embodiments of a channel provided in a sensing unit of FIG. 1.

FIG. 3A is a diagram illustrating an exemplary embodiment of a channel provided in the sensing unit of FIG. 1. In FIG. 3A, only one channel of the sensing unit coupled to the pixel of FIG. 2A is illustrated. However, a plurality of channels coupled to respective sensing lines SEN1 to SENm may be provided in the sensing unit. Further, an analog-to-digital converter (hereinafter referred to as an "ADC") 410 and a compensator 420, illustrated in FIG. 3A, may share a plurality of channels with each other.

Referring to FIG. 3A, the sensing unit 400 of the present disclosure includes a third switch SW3 coupled to an initialization power source Vint, the ADC 410, and the compensator 420.

The third switch SW3 is coupled between a sensing line SENm and the initialization power source Vint. The third switch SW3 is turned on or off under the control of the timing controller 500. When the third switch SW3 is turned on, the voltage of the initialization power source Vint is supplied to the sensing line SENm. Here, the initialization power source Vint is set to a constant voltage source, and is used to initialize the sensing line SENm.

The ADC 410 converts the voltage of the sensing line SENm into digital sensing data. For example, the sensing line SENm receives a voltage in response to the deviation in the characteristics of the first transistor M1 during the sensing period. The ADC 410 converts the voltage by the sensing line SENm into digital sensing data and supplies the digital sensing data to the compensator 420.

The compensator 420 stores the sensing data supplied from the ADC 410. For this operation, the compensator 420 may further include a memory (not illustrated). Such a compensator 420 may further include currently well-known various components, and may also be included in the timing controller 500.

Figure 3B:
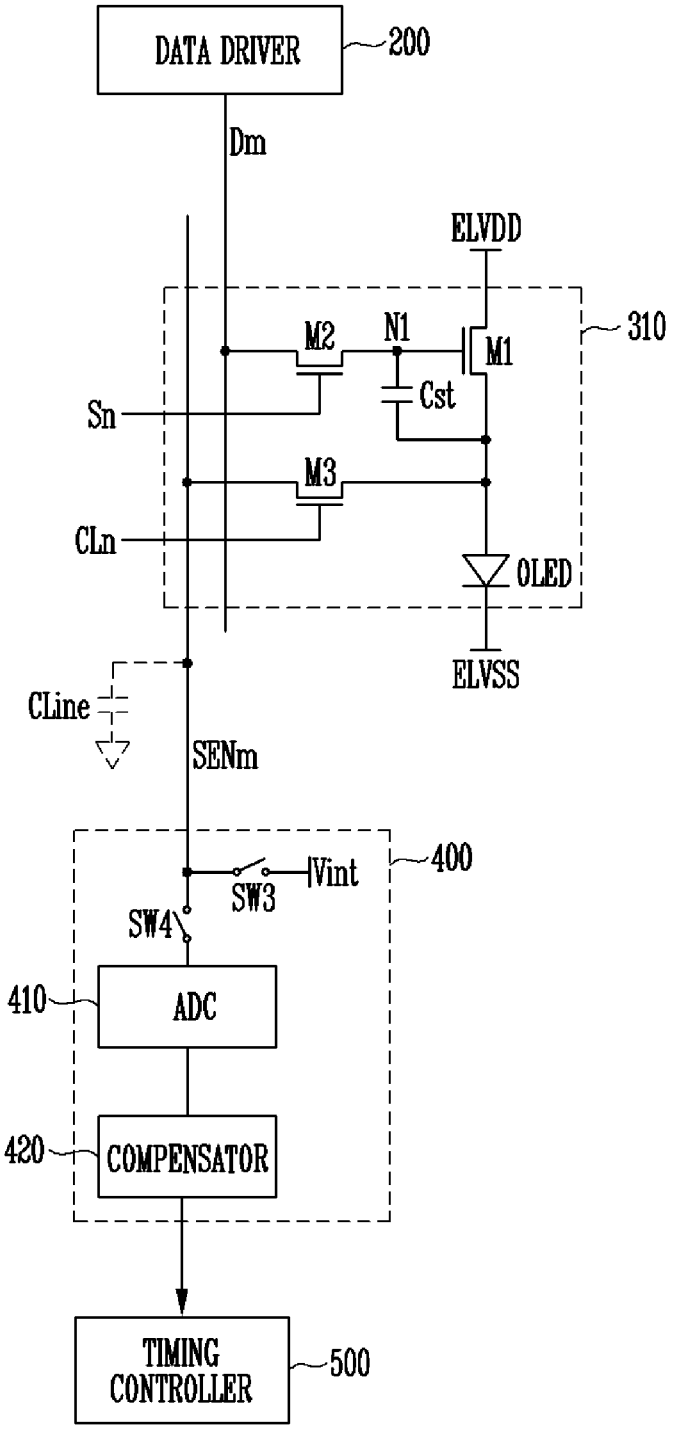

On the other hand, in the present disclosure, the sensing unit 400 may further include a fourth switch SW4 disposed between the sensing line SENm and the ADC 410, as illustrated in FIG. 3B. The fourth switch SW4 and the third switch SW3 may be alternately turned on and off.

For example, the fourth switch SW4 may remain turned off during a period in which the third switch SW3 is turned on and the voltage of the initialization power source Vint is supplied to the sensing line SENm. In this case, the stability of driving may be improved by preventing an unnecessary voltage from being supplied to the ADC 410.

Additionally, CLine illustrated in FIGS. 3A and 3B denotes a line capacitor CLine equivalently formed on the sensing line SENm. The line capacitor CLine stores voltage applied to the sensing line SENm.

Figure 4:
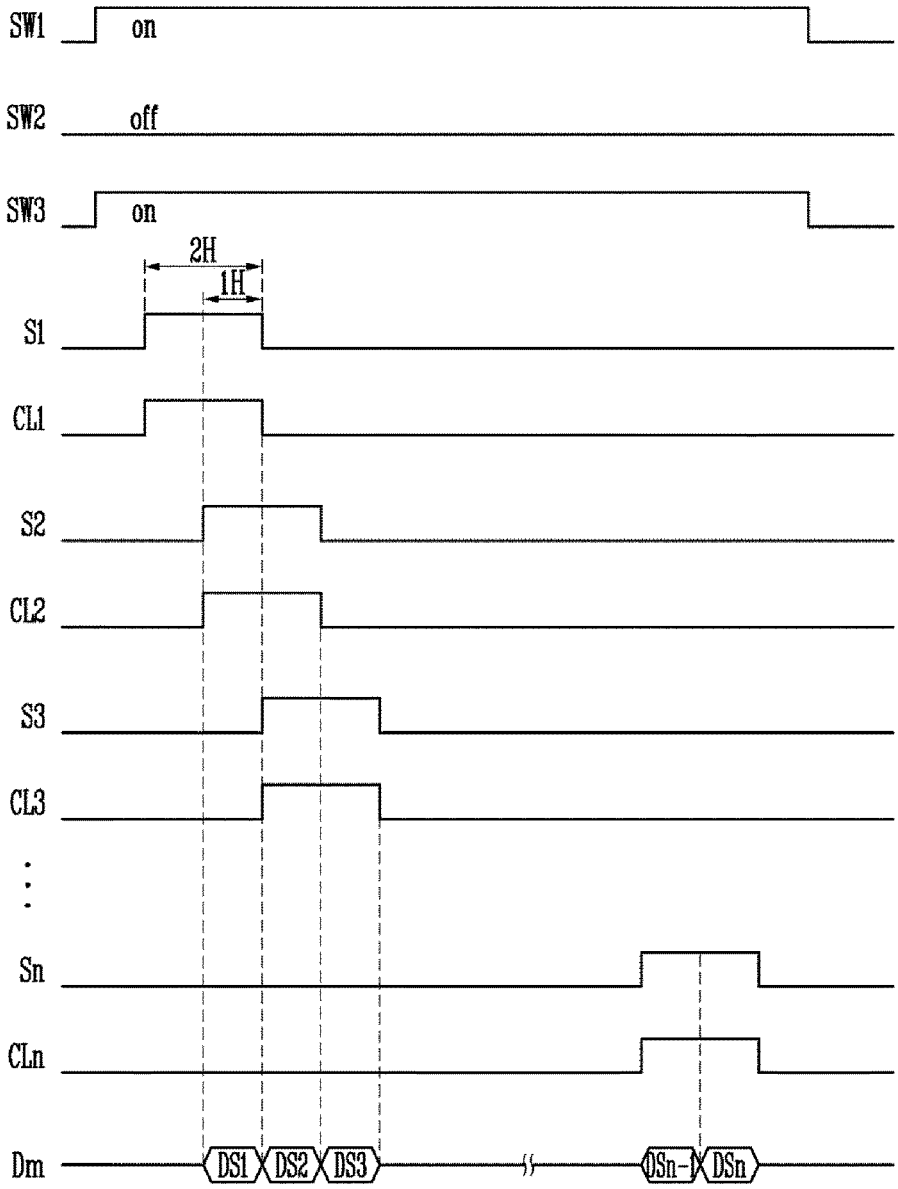
FIG. 4 is a diagram illustrating an example of driving waveforms supplied during a driving period.

FIG. 4 is a diagram illustrating an example of driving waveforms supplied during a driving period.

Referring to FIG. 4, first switches SW1 are turned on and second switches SW2 are set to a turned-off state during a driving period. When the first switches SW1 are turned on, a control line CLn is electrically coupled to a scan line Sn. Further, during the driving period, the third switches SW3 are set to a turned-on state. When the third switches SW3 are turned on, the voltage of the initialization power source Vint is supplied to the sensing lines SEN1 to SENm.

During the driving period, the scan driver 100 sequentially supplies scan signals to the scan lines S1 to Sn+1. Here, the scan driver 100 supplies a scan signal to the scan line Sn+1 so that the scan signal supplied to the scan line Sn+1 overlaps a scan signal supplied to the scan line Sn in a partial period of the entire period of each scan signal. In an exemplary embodiment, when the period of each scan signal is set to a period of 2H, the scan driver 100 may supply the scan signal to the scan line Sn+1 so that the scan signal overlaps the scan signal supplied to the scan line Sn during a period of 1H.

The scan signals supplied to the scan lines S1 to Sn+1 are also supplied to the control lines CL1 to CLn electrically coupled to the scan lines S1 to Sn+1. For example, the scan signal supplied to the scan line Sn is supplied to the control line CLn.

Therefore, the scan signal supplied to the scan line Sn is also supplied to the n control line CLn. When the scan signal is supplied to the scan line Sn, the second transistor M2 is turned on, whereas when the scan signal is supplied to the control line CLn, the third transistor M3 is turned on.

When the second transistor M2 is turned on, the data line Dm is electrically coupled to the first node N1. When the third transistor M3 is turned on, the sensing line SENm is electrically coupled to the second electrode of the first transistor M1.

During a period in which the second transistor M2 is turned on, an n−1-th data signal DSn-1 and an n-th data signal DSn are sequentially supplied to the data line Dm. Here, the data signal DSn-1 denotes a data signal corresponding to an n−1-th horizontal line, and the data signal DSn denotes a data signal corresponding to an n-th horizontal line.

The data signal DSn-1 and the n-th data signal DSn, which are sequentially supplied to the data line Dm, are supplied to the first node N1 via the second transistor M2. Here, the storage capacitor Cst stores a voltage corresponding to the n-th data signal DSn that is finally supplied.

When the third transistor M3 is turned on, the voltage of the initialization power source Vint, supplied from the sensing line SENm, is supplied to the second electrode of the first transistor M1. Then, the n-th data signal DSn is supplied to one terminal of the storage capacitor Cst, and the voltage of the initialization power source Vint is supplied to the other terminal thereof. In this case, the storage capacitor Cst stores a voltage corresponding to the difference between the voltages of the n-th data signal DSn and the initialization power source Vint.

Here, since the initialization power source Vint is set to a constant voltage source, the voltage stored in the storage capacitor Cst is determined by the n-th data signal DSn.

On the other hand, in an exemplary embodiment of the present disclosure, during a period in which the voltage of the data signal is charged in the storage capacitor Cst, the voltage of the initialization power source Vint is supplied to the other terminal of the storage capacitor Cst. Thus, a desired voltage may be stored in the storage capacitor Cst.

In detail, the other terminal of the storage capacitor Cst is electrically coupled to the anode electrode of the OLED. Here, the voltage of the anode electrode of the OLED may be changed due to the degradation of the OLED.

In this case, the voltage that is applied to the anode electrode of the OLED may be set to different voltages for respective pixels 310. Then, even if the same data signal is supplied, the voltage charged in the storage capacitor Cst may be set to different voltages in respective pixels 310. On the other hand, when the voltage of the initialization power source Vint is supplied to the other terminal of the storage capacitor Cst during a period in which the voltage is charged in the storage capacitor Cst, as in the case of the present disclosure, a desired voltage may be charged in the storage capacitor Cst regardless of the degradation of the OLED.

After a voltage corresponding to an m-th data signal DSm has been charged in the storage capacitor Cst, the supply of scan signals to the n-th scan line Sn and the n-th control line CLn is stopped. When the supply of the scan signals to the n-th scan line Sn and the n-th control line CLn is stopped, the second transistor M2 and the third transistor M3 are set to a turned-off state.

Thereafter, the first transistor M1 controls the amount of current that is supplied to the OLED in response to the voltage applied to the first node N1. Then, the OLED emits light at luminance corresponding to the amount of current from the first transistor M1.

In an exemplary embodiment of the present disclosure, during the driving period, an image is displayed on the pixel unit 300 while the above-described procedure is repeated.

Figure 5:
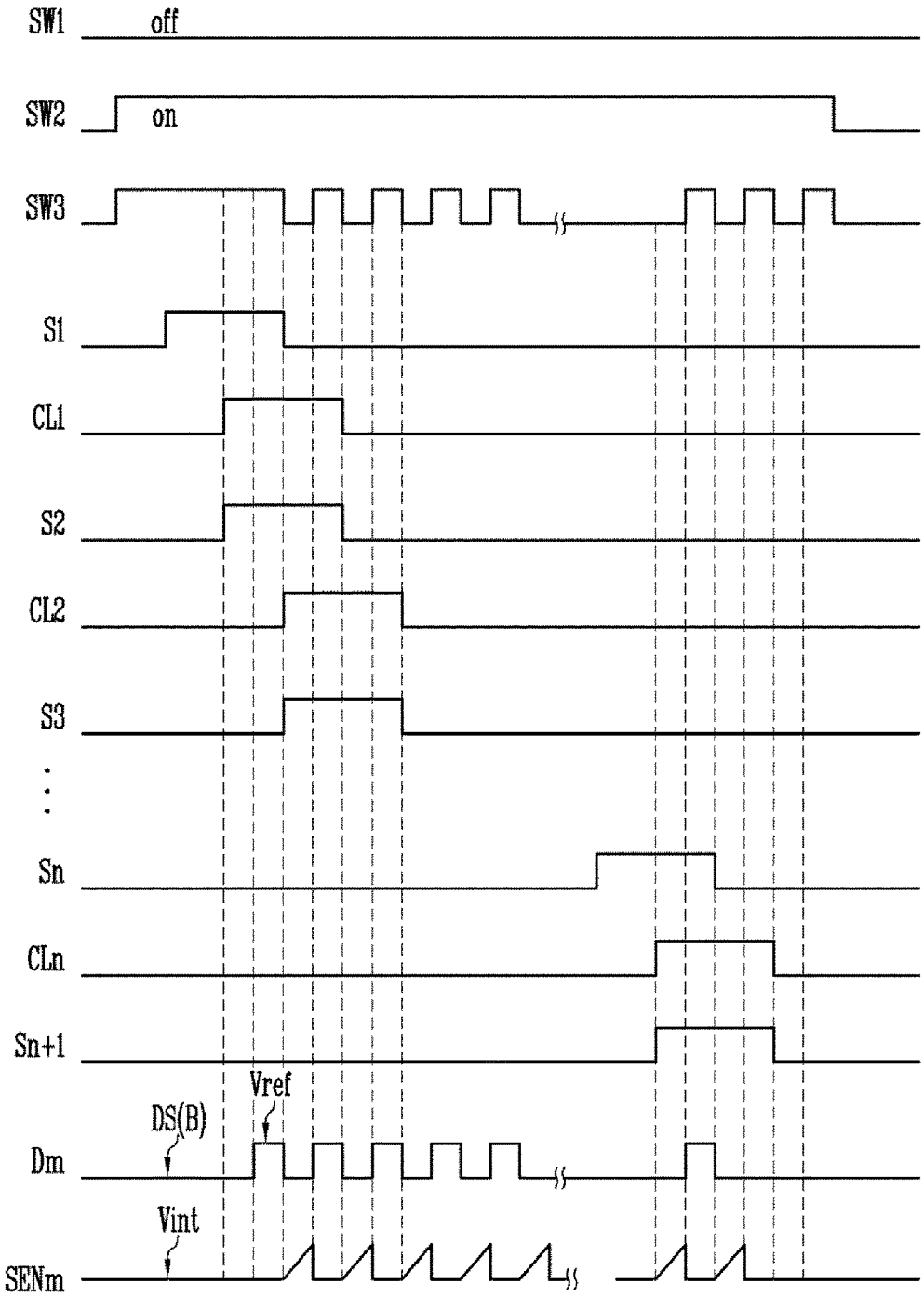
FIG. 5 is a diagram illustrating an example of driving waveforms supplied during a first sensing period.

FIG. 5 is a diagram illustrating an example of driving waveforms supplied during a first sensing period.

Referring to FIG. 5, first switches SW1 are turned off and second switches SW2 are set to a turned-on state during a first sensing period. When the second switches SW2 are set to a turned-on state, a control line CLn is electrically coupled to a scan line Sn+1. Further, during the first sensing period, third switches SW3 are repeatedly turned on and off. When the third switches SW3 are turned on, the voltage of the initialization power source Vint is supplied to sensing lines SEN1 to SENm.

During the first sensing period, the scan driver 100 may sequentially supply scan signals to the scan lines S1 to Sn+1. Here, the scan driver 100 supplies a scan signal to the scan line Sn+1 so that the scan signal supplied to the scan line Sn+1 overlaps a scan signal supplied to the scan line Sn in a partial period of the entire period of each scan signal.

The scan signals supplied to the scan lines S1 to Sn+1 are also supplied to the control lines CL1 to CLn electrically coupled to the scan lines S1 to Sn+1. For example, the scan signal supplied to the scan line Sn+1 is supplied to the control line CLn.

Therefore, the scan signal supplied to the scan line Sn+1 is also supplied to the n-th control line CLn.

The operating procedure are described below in detail in relation to FIGS. 3A, 5, and 6. Here, where a scan signal is supplied to the n-th scan line Sn, then the second transistor M2 is turned on. When the second transistor M2 is turned on, the data line Dm is electrically coupled to the first node N1.

Thereafter, a scan signal is supplied to the n-th control line CLn so that the scan signal supplied to the n-th control line CLn overlaps a scan signal supplied to the n-th scan line Sn in a partial period of the entire period of each scan signal. Here, the scan signal supplied to the n-th control line CLn is supplied from the (n+1)-th scan line Sn+1.

Figure 6:
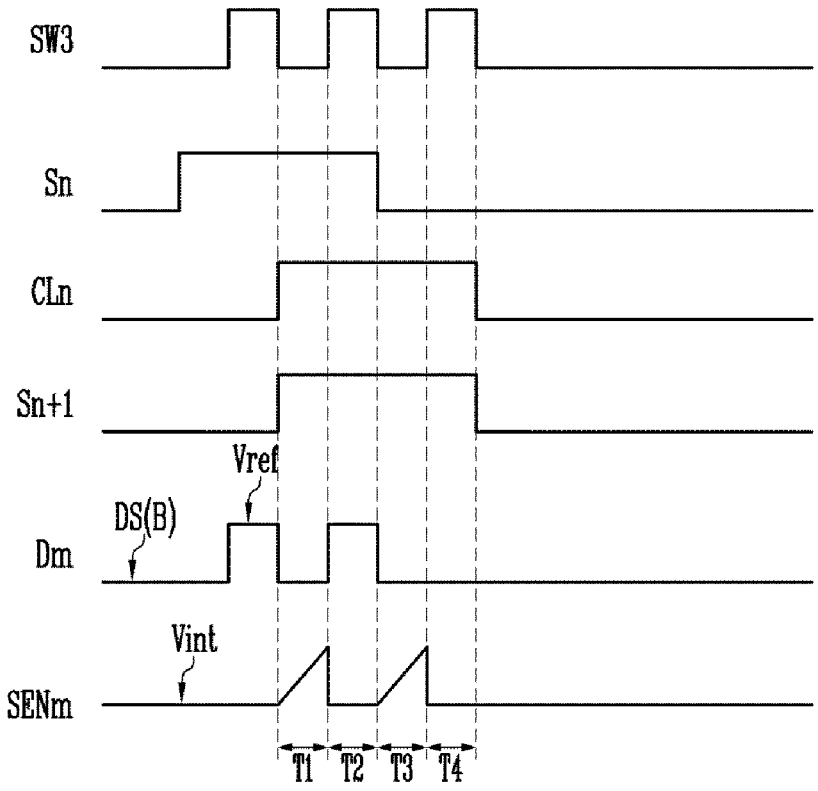
FIG. 6 is a diagram illustrating in detail the driving waveforms of FIG. 5.

Thereafter, for convenience, a period during which a scan signal is supplied to the control line CLn will be described as being divided into a first period T1 to a fourth period T4, as illustrated in FIG. 6.

When a scan signal is supplied to the n-th control line CLn, the third transistor M3 is turned on. When the third transistor M3 is turned on, the sensing line SENm is electrically coupled to the second electrode of the first transistor M1.

During the first period T1, a black data signal DS(B) is supplied to the data line Dm. When the black data signal DS(B) is supplied to the data line Dm, the first transistor M1 is set to a turned-off state. Here, a predetermined voltage is applied to the sensing line SENm in response to the mobility of the first transistor M1 included in the pixel 310 located on an n−1-th horizontal line. The ADC 410 converts the voltage applied to the sensing line SENm into digital sensing data, and supplies the digital sensing data to the compensator 420, and the compensator 420 stores the sensing data supplied thereto.

During the second period T2, a reference voltage Vref is supplied to the data line Dm. The reference voltage Vref supplied to the data line Dm is supplied to the first node N1 of the pixel 310 located on an n-th horizontal line. Here, the reference voltage Vref is set to a voltage that enables the first transistor M1 to be turned on, and thus current corresponding to the reference voltage Vref is supplied from the first transistor M1 to the sensing line SENm via the third transistor M3.

During the second period T2, the third switch SW3 is set to a turned-on state. When the third switch SW3 is set to a turned-on state, the voltage of the initialization power source Vint is supplied to the sensing line SENm. That is, during the second period T2, the sensing line SENm is initialized to the voltage of the initialization power source Vint. Therefore, during the second period T2, the sensing line SENm is maintained at the voltage of the initialization power source Vint regardless of the current flowing from the first transistor M1.

During the third period T3, the supply of the scan signal to the n-th scan line Sn is stopped. When the supply of the scan signal to the n-th scan line Sn is stopped, the second transistor M2 is turned off. Therefore, during the third period T3, the black data signal DS(B) that is supplied to the data line Dm is not provided to the first node N1.

Further, during the third period T3, the third switch SW3 is turned off. When the third switch SW3 is turned off, the voltage of the initialization power source Vint is not supplied to the sensing line SENm. Therefore, during the third period T3, a voltage is applied to the sensing line SENm in response to the current supplied from the pixel 310 located on the n-th horizontal line.

Here, the voltage applied to the sensing line SENm is determined depending on the mobility of the first transistor M1. That is, the voltages applied to the sensing lines SEN1 to SENm during the third period T3 may be set differently depending on the movement of the driving transistors included in the respective pixels 310.

The ADC 410 converts the voltage applied to the sensing line SENm into digital sensing data, and supplies the digital sensing data to the compensator 420, and the compensator 420 stores the sensing data supplied thereto. Here, the sensing data stored in the compensator 420 corresponds to the mobility information of the driving transistor included in the pixel 310 coupled to the m-th data line Dm and the n-th scan line Sn.

Meanwhile, in an exemplary embodiment of the present disclosure, during the third period T3, the second transistor M2 is turned off, and the third transistor M3 is set to a turned-on state. Then, one terminal (i.e., the first node) of the storage capacitor Cst is set to a floating state.

Therefore, even if the voltage of the other terminal of the storage capacitor Cst increases in accordance with an increase in the voltage of the sensing line SENm, the voltage charged in the storage capacitor Cst remains constant. That is, during the third period T3, the gate-source voltage Vgs of the first transistor M1 may remain constant, so that the accuracy of the mobility information of the first transistor M1 may be improved.

In other words, if one terminal of the storage capacitor Cst is not set to a floating state during the third period T3, the voltage charged in the storage capacitor Cst changes in accordance with the increase in the voltage of the sensing line SENm, and thus the accuracy of mobility information decreases.

During the fourth period T4, the third switch SW3 is turned on, and thus the voltage of the initialization power source Vint is supplied to the sensing line SENm. Then, the sensing line SENm is initialized to the voltage of the initialization power source Vint.

In an exemplary embodiment of the present disclosure, during the first sensing period, the mobility information of the driving transistors included in the respective pixels 310 is extracted while the above-described procedure is repeated.

Figure 7:
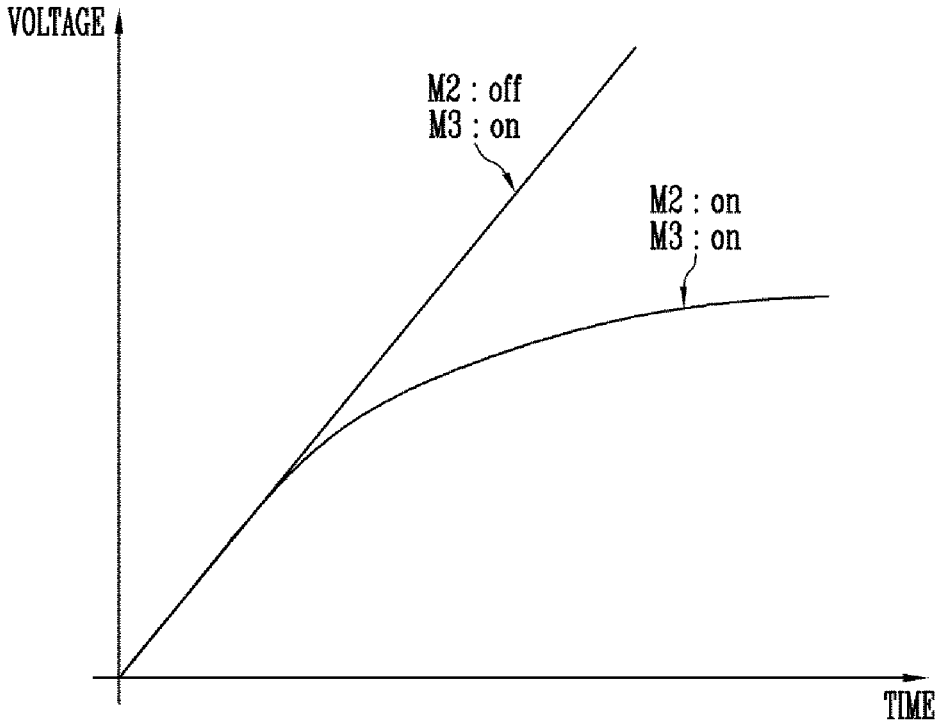

FIG. 7 is a diagram illustrating mobility sensing voltages depending on whether the second transistor and the third transistor illustrated in FIG. 2A are turned on.

Referring to FIG. 7, when the second transistor M2 and the third transistor M3 are set to a turned-on state during a period (i.e., the third period T3 of FIG. 6) in which voltages corresponding to mobility are applied to the sensing lines SEN1 to SENm, accurate voltages corresponding to mobility are not applied to the sensing lines SEN1 to SENm due to the change in the voltage of the storage capacitor Cst.

On the other hand, as in the case of the exemplary embodiment of the present disclosure, when the second transistor M2 is turned off and the third transistor M3 is set to a turned-on state during a period (i.e., the third period T3 of FIG. 6) in which voltages corresponding to mobility are applied to the sensing lines SEN1 to SENm, accurate voltages corresponding to mobility are applied to the sensing lines SEN1 to SENm because the voltage of the storage capacitor Cst does not change.

Figure 8:
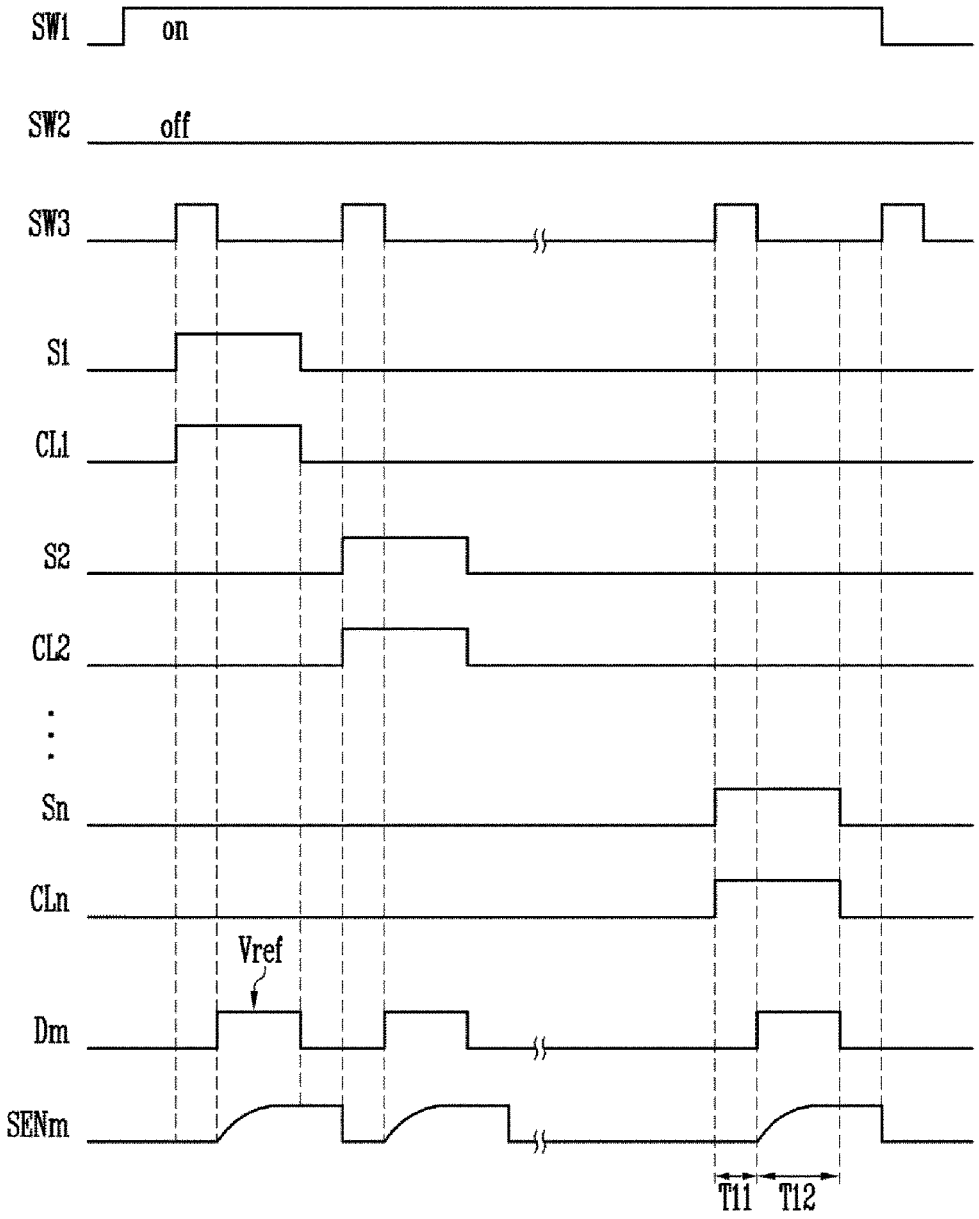
FIG. 8 is a diagram illustrating an example of driving waveforms supplied during a second sensing period.

FIG. 8 is a diagram illustrating an example of driving waveforms supplied during a second sensing period.

Referring to FIG. 8, first switches SW1 are turned on and second switches SW2 are set to a turned-off state during the second sensing period. When the first switches SW1 are set to a turned-on state, the control line CLn is electrically coupled to the scan line Sn. The third switches SW3 are turned on during initial parts of periods in which scan signals are supplied. When the third switches SW3 are turned on, the voltage of the initialization power source Vint is supplied to the sensing lines SEN1 to SENm.

During the second sensing period, the scan driver 100 sequentially supplies scan signals to the scan lines S1 to Sn+1. Here, the scan driver 100 supplies a scan signal to the scan line Sn+1 so that the scan signal supplied to the scan line Si+1 does not overlap a scan signal supplied to the scan line Sn.

The scan signals supplied to the scan lines S1 to Sn+1 are also supplied to the control lines CL1 to CLn electrically coupled to the scan lines S1 to Sn+1. For example, the scan signal supplied to the scan line Sn is supplied to the control line CLn.

Therefore, the scan signal supplied to the n-th scan line Sn is also supplied to the n-th control line CLn. When the scan signal is supplied to the n-th scan line Sn, the second transistor M2 is turned on, whereas when the scan signal is supplied to the n-th control line CLn, the third transistor M3 is turned on.

When the second transistor M2 is turned on, the data line Dm is electrically coupled to the first node N1. When the third transistor M3 is turned on, the sensing line SENm is electrically coupled to the second electrode of the first transistor M1.

During a period 11 (T11) of an entire period in which the scan signal is supplied to the n-th scan line Sn, the third switch SW3 is turned on. When the third switch SW3 is turned on, the voltage of the initialization power source Vint is supplied to the sensing line SENm, and thus the voltage of the sensing line SENm is initialized to the voltage of the initialization power source Vint.

During a period 12 (T12) of the entire period in which the scan signal is supplied to the n-th scan line Sn, the reference voltage Vref is supplied to the data line Dm. The reference voltage Vref supplied to the data line Dm is provided to the first node N1. Here, the first transistor M1 supplies a predetermined current to the sensing line SENm in response to the reference voltage Vref.

Then, the voltage of the sensing line SENm gradually increases. Further, the voltage of the sensing line SENm finally increases up to a voltage obtained by subtracting the threshold voltage of the first transistor M1 from the reference voltage Vref. That is, during the second sensing period, the voltage applied to the sensing line SENm is determined in accordance with the threshold voltage of the first transistor M1.

The ADC 410 converts the voltage applied to the sensing line SENm into digital sensing data and supplies the digital sensing data to the compensator 420, and the compensator 420 stores the sensing data supplied thereto. Here, the sensing data stored in the compensator 420 corresponds to the threshold voltage information of the driving transistor included in the pixel 310 coupled to the m-th data line Dm and the n-th scan line Sn.

Meanwhile, in an exemplary embodiment of the present disclosure, the width of a scan signal supplied during the second sensing period may be set to a sufficiently large width so that the voltage corresponding to the threshold voltage of the first transistor M1 may be applied to the sensing line SENm.

In an exemplary embodiment of the present disclosure, during the second sensing period, the threshold voltage information of the driving transistors included in the respective pixels 310 is extracted while the above-described procedure is repeated.

In accordance with the display device and the method of driving the display device according to exemplary embodiments of the present disclosure, the threshold voltage information and the mobility information of driving transistors included in respective pixels may be sensed. Further, second data may be generated by changing a bit of first data that is externally input in accordance with threshold voltage information and mobility information, and data signals may be generated using the second data. In this case, light having uniform luminance may be emitted from respective pixels in response to data signals regardless of deviations in the threshold voltages and mobility values of driving transistors, and thus image quality may be improved.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular exemplary embodiment may be used alone or in combination with features, characteristics, and/or elements described in connection with other exemplary embodiments unless otherwise specifically indicated.

Although certain exemplary embodiments and implementations have been described herein, other embodiments and modifications will be apparent from this description. Accordingly, the inventive concepts are not limited to such embodiments, but rather to the broader scope of the presented claims and various obvious modifications and equivalent arrangements.

What is claimed is:

1. A display device, comprising:

pixels comprising driving transistors disposed to be coupled to scan lines, data lines, and sensing lines;

a scan driver configured to supply scan signals to the scan lines;

a data driver configured to supply at least one of a reference voltage and data signals to the data lines;

a sensing unit configured to sense characteristic information of the driving transistors via the sensing lines during a sensing period;

control lines formed in parallel with the scan lines;

a first switch coupled between an n-th scan line, where n is a natural number, and an n-th control line; and a second switch coupled between the n-th control line and an (n+1)-th scan line and configured such that a turn-on period of the second switch does not overlap a turn-on period of the first switch, wherein the display device is configured to be driven in a period that is divided into a driving period during which an image is displayed and the sensing period during which the characteristic information of the driving transistors is sensed.

2. The display device according to claim 1, wherein the reference voltage is set to a voltage that allows current to flow through the driving transistors.

3. The display device according to claim 1, wherein the first switch is turned on during the driving period.

4. The display device according to claim 3, wherein the scan driver sequentially supplies scan signals to the scan lines during the driving period.

5. The display device according to claim 4, wherein a scan signal supplied to the (n+1)-th scan line overlaps a scan signal supplied to the n-th scan line in a partial period of an entire period of each scan signal.

6. The display device according to claim 1, wherein the sensing period is set to a first sensing period during which mobility information of a driving transistor is sensed and a second sensing period during which threshold voltage information of the driving transistor is sensed.

7. The display device according to claim 6, wherein the second switch is turned on during the first sensing period.

8. The display device according to claim 7, wherein the scan driver sequentially supplies scan signals to the scan lines during the driving period.

9. The display device according to claim 8, wherein a scan signal supplied to the n-th scan line and a scan signal supplied to the n-th control line overlap each other in a partial period of an entire period of each scan signal.

10. The display device according to claim 9, wherein the data driver is configured to sequentially supply a data signal having a black grayscale level and the reference voltage to the data lines during the partial period.

11. The display device according to claim 6, wherein the first switch is turned on during the second sensing period.

12. The display device according to claim 11, wherein the scan driver sequentially supplies scan signals to the scan lines during the second sensing period, wherein the scan signals do not overlap each other.

13. The display device according to claim 12, wherein the data driver is configured to supply the reference voltage to the data lines during a partial period of an entire period in which the scan signals are supplied.

14. The display device according to claim 1, wherein the sensing unit comprises:

third switches respectively formed between an initialization power source and the sensing lines;

an analog-to-digital converter coupled to at least one of the sensing lines and configured to convert voltages applied to the sensing lines into digital sensing data depending on the characteristic information of the driving transistors; and a compensator comprising a memory for storing the sensing data.

15. The display device according to claim 14, wherein the third switches are configured such that the third switches are set to a turned-on state during the driving period and are repeatedly turned on and off during the sensing period.

16. The display device according to claim 14, wherein the sensing unit further comprises fourth switches disposed between the respective sensing lines and the analog-to-digital converter and configured such that turn-on periods of the fourth switches do not overlap turn-on periods of the third switches.

17. The display device according to claim 1, wherein each of pixels located on a n-th horizontal line comprises:

an organic light-emitting diode;

a driving transistor configured to control an amount of current that flows from a first driving power source to a second driving power source via the organic light-emitting diode in response to a voltage of a first node;

a second transistor coupled between the first node and a data line, and a gate electrode of the second transistor is coupled to the n-th scan line;

a third transistor coupled between a second electrode of the driving transistor and a sensing line, and a gate electrode of the third transistor is coupled to the n-th control line; and a storage capacitor coupled between the first node and the second electrode of the driving transistor.

18. The display device according to claim 1, further comprising a timing controller configured to generate second data using first data that is externally supplied depending on the characteristic information.

19. A method of driving a display device, comprising:

during a first sensing period:

turning on a second transistor coupled between a gate electrode of each driving transistor and a data line;

turning on a third transistor coupled between a second electrode of the driving transistor and a sensing line after the second transistor has been turned on;

sequentially supplying the data line with a data signal that has a black grayscale level and a reference voltage that allows current to flow through the driving transistor;

turning off the second transistor; and sensing a voltage applied to the sensing line as mobility information while maintaining the third transistor in a turned-on state, wherein the display device is configured to be driven in a period that is divided into a driving period during which an image is displayed, the first sensing period during which mobility information of driving transistors included in respective pixels is sensed, and a second sensing period during which threshold voltage information of the driving transistors is sensed.

20. The method according to claim 19, further comprising:

during the second sensing period:

simultaneously turning on the second transistor and the third transistor;

initializing the sensing line to a voltage of an initialization power source;

supplying the reference voltage to the data line; and sensing a voltage applied to the sensing line as the threshold voltage information.

* * * * *